US007510257B2

(12) United States Patent
Jung et al.

(10) Patent No.: US 7,510,257 B2
(45) Date of Patent: Mar. 31, 2009

(54) INK LEVEL DETECTING DEVICE FUNCTIONING AS COVER OPENING SENSOR AND INK-JET IMAGE FORMING APPARATUS HAVING THE SAME

(75) Inventors: Dong-kee Jung, Seoul (KR); Jung-hwan Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 240 days.

(21) Appl. No.: 11/497,303

(22) Filed: Aug. 2, 2006

(65) Prior Publication Data

US 2007/0064028 A1 Mar. 22, 2007

(30) Foreign Application Priority Data

Aug. 5, 2005 (KR) ..... 10-2005-0071696

(51) Int. Cl.
*B41J 2/195* (2006.01)
*B41J 29/393* (2006.01)
*B41J 2/175* (2006.01)

(52) U.S. Cl. ..... 347/19; 347/7; 347/86

(58) Field of Classification Search ..... 347/7, 347/19, 86

See application file for complete search history.

(56) References Cited

U.S. PATENT DOCUMENTS 5,682,184 A 10/1997 Stephany et al.
6,247,363 B1 * 6/2001 Froger et al. ..... 73/304 C

FOREIGN PATENT DOCUMENTS

| | | |
|---|---|---|
| JP | 59-075122 | 4/1994 |
| JP | 10-100445 | 4/1998 |
| KR | 1998-16870 | 6/1998 |

* cited by examiner

*Primary Examiner*—Julian D Huffman
(74) *Attorney, Agent, or Firm*—Stein, McEwen & Bui, LLP

(57) ABSTRACT

An ink level detecting device also functions as a cover opening sensor, and an ink-jet image forming apparatus having the ink level detecting device functions in the same way. The ink level detecting device detects an ink level in an ink container mounted on an ink container mounting unit, and includes a first electrode disposed on an inner surface of a cover which covers the ink container mounting unit and a second electrode disposed on the ink container. The ink level detecting device detects an opening of the cover as well as an ink level variation by sensing a variation in a capacitance between the first and second electrodes.

19 Claims, 6 Drawing Sheets

INK LEVEL DETECTING DEVICE FUNCTIONING AS COVER OPENING SENSOR AND INK-JET IMAGE FORMING APPARATUS HAVING THE SAME

CROSS-REFERENCE TO RELATED APPLICATIONS

This application claims the benefit of Korean Patent Application No. 2005-71696, filed on Aug. 5, 2005, in the Korean Intellectual Property Office, the disclosure of which is incorporated herein by reference.

BACKGROUND OF THE INVENTION

1. Field of the Invention

Aspects of the present invention relate to an ink level detecting device functioning as a cover opening sensor in an ink-jet image forming apparatus, and more particularly, to an ink level detecting device that can also function as a cover opening sensor by using a plurality of electrodes arranged in parallel with each other.

2. Description of the Related Art

Generally, ink-jet image forming apparatuses form images by ejecting ink through an ink ejecting head. Examples of the ink-jet forming apparatuses include ink-jet printers, ink-jet copy machines, facsimiles, all-in-one printers, and the like.

An ink-jet image forming apparatus receives ink from an ink container such as an ink cartridge. The ink filled in the ink container is supplied to the ink ejecting head directly or through a predetermined ink supply passage and ejected in response to a print signal. As an image forming process is being performed, the amount of ink filled in the ink container is reduced and the ink level in the ink container is lowered. When the ink level reaches a minimum level, either the ink container must be refilled, or the used ink container must be replaced with a new ink container.

Therefore, a conventional ink-jet image forming apparatus includes an ink level detecting device which detects the ink level in an ink container. Also, a main body of the image forming apparatus has an ink container mounting unit and a cover for opening and closing the ink container mounting unit. In addition, the ink-jet image forming apparatus includes a cover opening sensor which senses the opening and closing of the cover and transmits a signal to a central processing unit in the main body so that the cover opening state, i.e., the status of whether the cover is open or closed, can be displayed through a display unit and properly controlled.

A reflective or transmitting photo sensor, a magnetic sensor, a contact type switch sensor, and the like have all been widely used as various types of cover opening sensors. However, in the conventional models, the cover opening sensor is an independent unit from the ink level detecting device and is usually mounted on the ink container itself or is mounted on an ink container mounting unit, thereby requiring the image forming apparatus to have a special internal connecting structure. Thus, the conventional image forming apparatus has a complicated structure because its cover opening sensor and ink level detecting device are independent of each other, and the manufacturing cost thereof is expensive.

SUMMARY OF THE INVENTION

Aspects of the present invention provide an ink level detecting device which can also function as a cover opening sensor capable of sensing when a cover covering an ink container mounting unit is opened and closed by using a plurality of electrodes arranged in parallel with each other.

According to an aspect of the present invention, there is provided an ink level detecting device which detects an ink level in an ink container mounted on an ink container mounting unit, the ink level detecting device including a first electrode disposed at a cover covering the ink container mounting unit, and a second electrode disposed on the ink container, wherein the ink level detecting device detects an opening of a cover as well as an ink level variation by sensing a capacitance variation between the first and second electrodes.

When the cover is open, the capacitance variation preferably falls out of the variation range, and specifically, falls out of the variation range of a capacitance used to measure the ink level variation when the cover is closed.

The second electrode may preferably be disposed on a top or bottom of the ink container and the first electrode may preferably be disposed on an inner surface of the cover. However, the first and second electrodes may also be located elsewhere. When the cover is closed, the capacitance between the first and second electrodes is relatively high. When the cover is open, the capacitance between the first and second electrodes is approximately equal to zero.

The ink level detecting device detects an on/off variation of the capacitance. In addition, when the cover is closed, the ink level detecting device detects the ink level by allowing the capacitance to vary within a predetermined range as the ink level varies. When the cover is closed, the variation of the capacitance by the variation of the ink level may be less than the variation of the capacitance according to the cover opening state. In other words, the capacitance between the first and second electrodes may be greater than the capacitance in the cover opening state, even when the ink level reaches a minimum level. Since the capacitance of the cover opening state is lower than any capacitance of the cover closed stated, even a cover closed state when the ink level is low, the ink level detecting device can distinguish the reduction of the ink level from the opening/closing of the cover.

When the second electrode is disposed on an upper portion of the ink container, a structure for horizontally moving the second electrode according to the variation of the ink level is provided so that the ink level can be detected by detecting the variation of the capacitance according to an area where the first electrode faces the second electrode.

When the second electrode is disposed on a bottom of the ink container, the ink level is detected by detecting the variation of the capacitance according to variation in the shape of a flexible ink pack provided between the first and second electrodes or by detecting a variation of the dielectric constant according to an amount of the remaining ink in the flexible ink pack disposed between the first and second electrodes.

The method of detecting the ink level when the cover is closed is not limited to the above examples. So long as the electrodes are disposed in parallel with each other, any method and device can be employed.

According to another aspect of the present invention, there is provided an ink level detecting device of an ink-jet image forming apparatus, which detects an ink level in an ink container mounted on an ink container mounting unit, the ink level detecting device including a first electrode disposed at a cover covering the ink container mounting unit, a shrinkable ink pack received in an ink container and having a top that is vertically lowered as an amount of remaining ink contained therein is reduced, and a second electrode disposed on an upper portion of the ink container and facing the first electrode at a predetermined distance from the first electrode, wherein the second electrode moves horizontally in accordance with a variation of a height of the top of the shrinkable ink pack so that an area where the first and second electrodes face each other can vary, so that the ink level detecting device detects a cover opening state as well as an ink level variation by sensing a capacitance variation between the first and second electrodes.

The ink container, which functions as a housing to accommodate the shrinkable ink pack, is not limited to a specific shape. The ink container may preferably be designed having a sealed bottom and sealed sides. The ink container may preferably be formed out of plastic, but may also be formed out of other materials.

When the cover is closed, the second electrode slides horizontally. At this point, the sliding distance may be proportional to a variation of a height of the shrinkable ink pack, which is reduced as ink is supplied to the ink ejecting head. The shrinkable ink pack may preferably be formed out of a laminating film with an aluminum layer and have a discharge hole through which the ink is discharged. At least one folding line is formed on a side portion of the shrinkable ink pack so that a top of the ink pack can be lowered as the amount of the remaining ink is supplied to the ink ejecting head and therefore reducing the amount of ink in the ink pack. Any ink pack having these properties may be used in accordance with aspects of the present invention.

The first and second electrodes are designed to function as a capacitor, where the capacitance varies according to a variation of the common surface area where the first and second electrodes face each other. The first and second electrodes are formed out of a conductive material. Particularly, the second electrode may preferably be formed out of a flexible conductive film, such as a thin metal plate, a thin metal film, and a synthetic resin film having a coated metal layer that can be curved along an inner wall of the ink container.

The capacitance of a capacitor is given by the following equation:

$$C=\in\cdot A/d[F]$$

Where the variable A represents a common surface area in which the electrodes face each other, d represents a distance between the electrodes as measured between the portions of the electrodes facing each other, and $\in$ is a dielectric constant measured between the portions of the electrodes facing each other. The ink level detecting device allows the area A to vary linearly and detects the ink level through the variation of the capacitance that can be electrically detected. The variation in the capacitance may be measured by a capacity meter, or detected through a parameter related to the capacitance, such as an output voltage with respect to an input of an alternating current having a predetermined frequency.

When the variation of the capacitance is detected using a continuous value, the ink level may be detected by comparing a detected signal with a series of calibrated signals.

Additional aspects and/or advantages of the invention will be set forth in part in the description which follows and, in part, will be obvious from the description, or may be learned by practice of the invention.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE EMBODIMENTS

Figure 1:
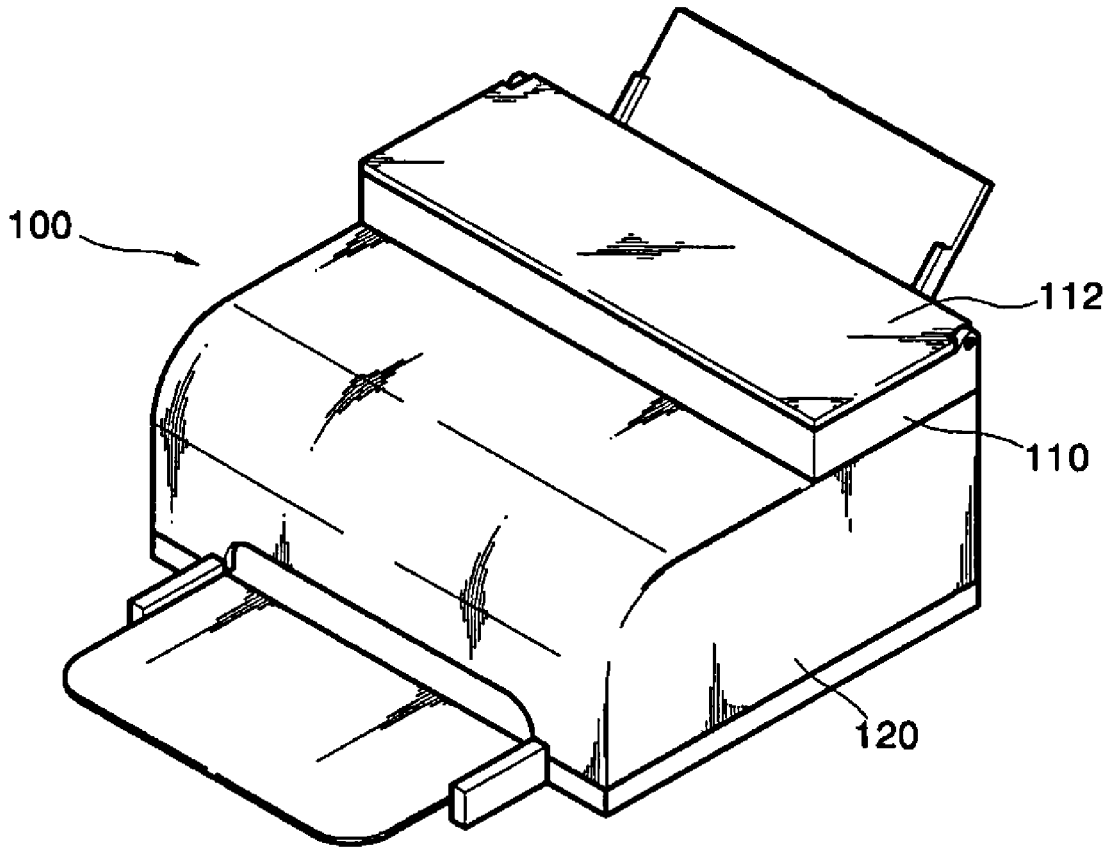
FIG. 1 is a perspective view of an image forming apparatus that can use the ink level detecting device of the various embodiments of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 shows an example of an image forming apparatus 100 capable of having an ink level detecting device according to various embodiments the present invention.

As shown in FIG. 1, the image forming apparatus 100 includes a main body 120 having paper input and output portions, an ink container mounting unit 110, and a cover 112 which covers the ink container mounting unit 110.

Alternatively, the ink container mounting unit 110 may be included in the main body 120 to be opened and closed by the cover of the main body 120. In this case, the cover of the main body 120 functions as the cover 112.

Figure 2:
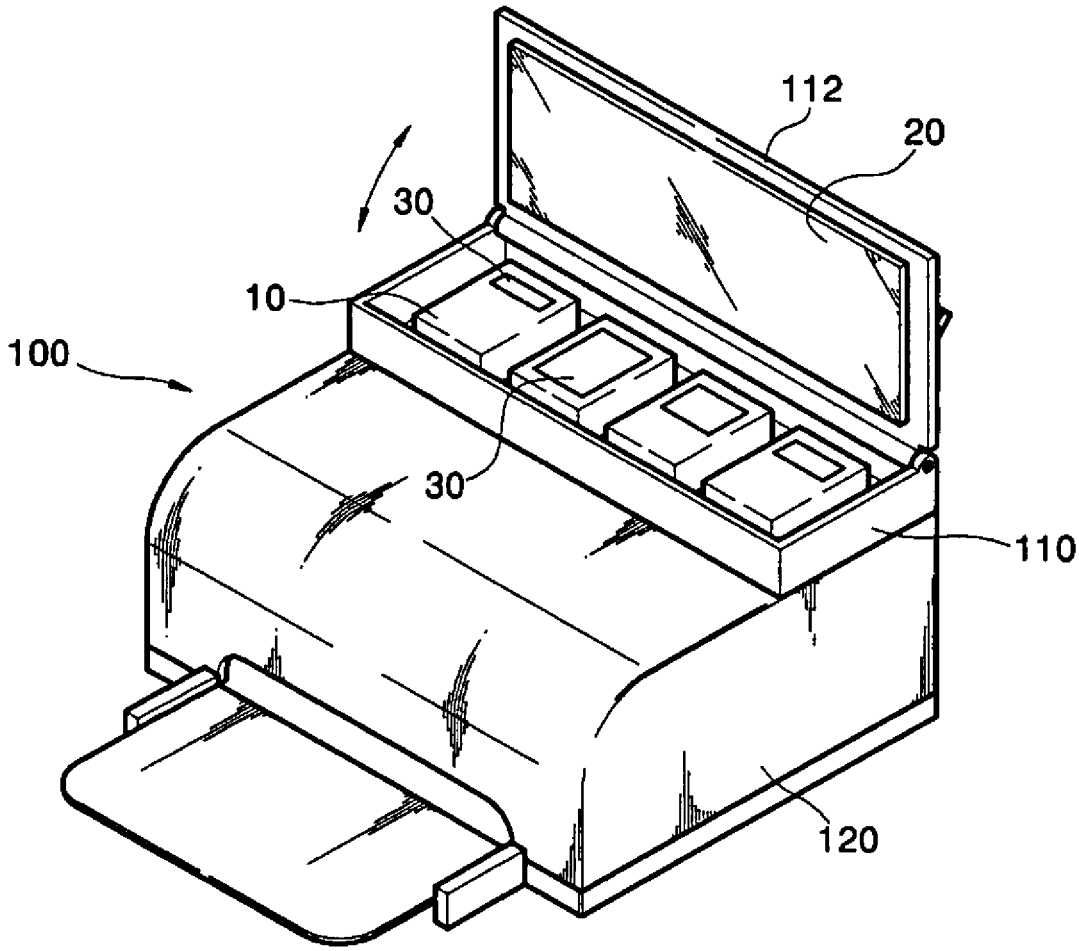
FIG. 2 is a perspective view of the image forming apparatus illustrated in FIG. 1, when a cover which covers an ink container mounting unit is open.

FIG. 2 shows the image forming apparatus 100 when the cover 112 is open.

As shown in FIG. 2, a first electrode 20 is placed on an inner surface of the cover 112 and a second electrode 30 is placed on the top of each of the ink containers 10. Alternatively, the second electrode 30 may be formed on a bottom of the ink container 10 according to an ink level detecting mechanism.

When the cover 112 is closed, the first electrode 20 and each of the second electrodes 30 are designed to function as a capacitor where the capacitance varies according to an ink level. When the cover 112 is opened, as shown in FIG. 2, the first and second electrodes 20 and 30 are not oriented parallel to each other anymore and the capacitance between the first electrode 20 and the second electrode 30 drops to approximately zero.

The first electrode 20 may be formed in a plurality of sections, so that the apparatus 100 would have a section for each first electrode 20 corresponding to each of the respective second electrodes 30. Alternatively, the first electrode may be formed in a single body which corresponds to all of the second electrodes 30. It is preferable to form the first electrode 20 in a single body to simplify the structure of the apparatus and the signal process.

Figure 3:
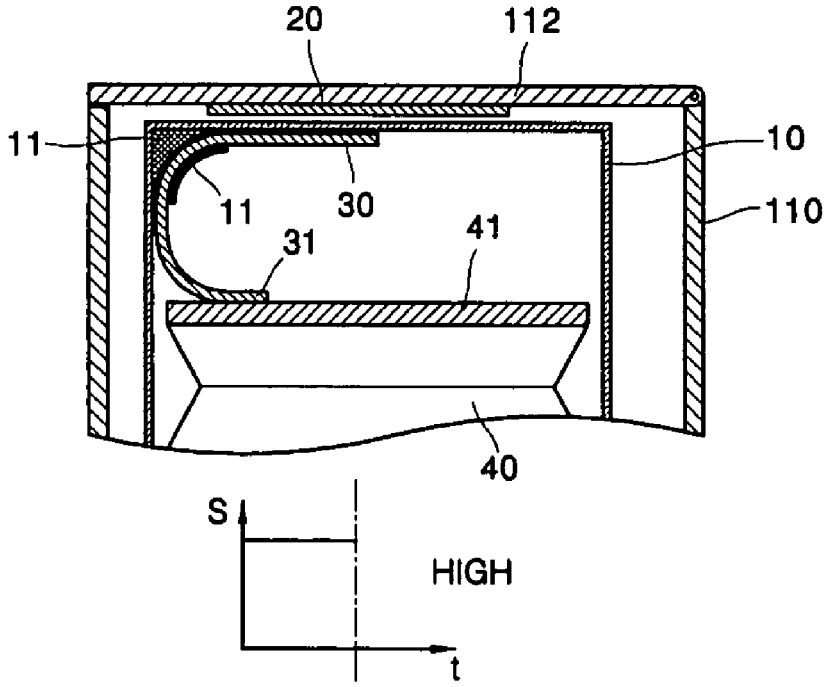
FIG. 3 is a side sectional view of an ink level detecting device according to an embodiment of the present invention, when the cover which covers the ink container mounting unit is closed.

FIG. 3 is a side sectional view of an ink level detecting device according to an embodiment of the present invention, when the cover 112 which covers the ink container mounting unit 110 is closed.

As shown in FIG. 3, the first electrode 20 is placed on an inner surface of the cover 112 which is pivotally mounted on a side portion of the ink container mounting unit 110. The second electrode 30 is placed on an upper portion of the ink container 10. The first and second electrodes 20 and 30 are disposed such that the common surface area where the first and second electrodes 20 and 30, respectively, face each other varies according to the displacement of the second electrode 30.

When the cover 112 is closed, the first and second electrodes 20 and 30 function as a capacitor to detect the ink level in the ink container 10. This function is described below in more detail.

A flexible ink pack 40 is provided in the ink container 10. The flexible ink pack 40 has an ink outlet (not shown) which supplies the ink to an ink discharge unit (not shown). The flexible ink pack 40 shrinks in volume as the ink is discharged through the ink outlet. Thus, the height of the flexible ink pack 40 is reduced. The flexible ink pack 40 is preferably formed out of a film which is thicker in the top and bottom of the flexible ink pack 40 than it is on the side portions of the flexible ink pack 40, so that the top and bottom can have a flat shape. In this embodiment, a reinforcing plate 41 is provided on the top of the flexible pack 40. The reinforcing plate 41 can be made of many different types of materials, including, plastic, aluminum, etc.

Figure 4:
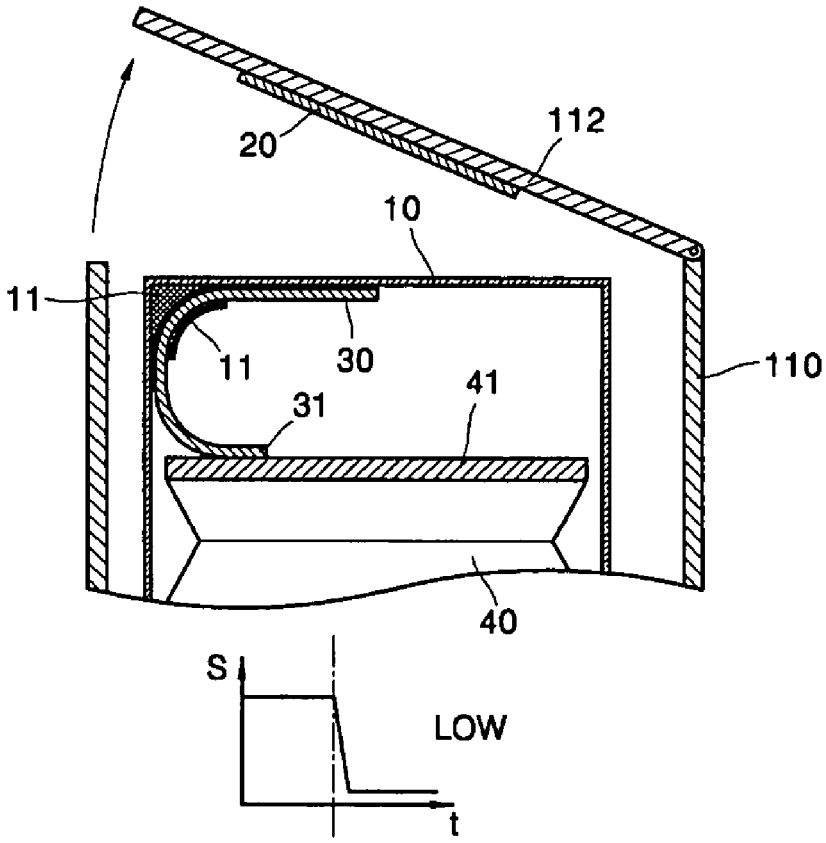
FIG. 4 is a side sectional view of the ink level detecting device illustrated in FIG. 3, when the cover is open.

The second electrode 30 extends along a sidewall of the ink container 10 and is curved in a C-shape so that a front end portion thereof contacts the top of the flexible ink pack 40. When the reinforcing plate 41 is provided on the top of the flexible pack 40, the front end portion of the second electrode 30 is fixed on the reinforcing plate 41. Therefore, when the top of the flexible ink pack 40 is lowered, the second electrode 30 slides down along a guide unit 11 which is provided on a sidewall of the ink container 10, as shown in FIGS. 3 and 4. The Thus, the common surface area where the first and second electrodes 20 and 30, respectively, face each other is reduced, and therefore the capacitance, which varies according to this common surface area of the first and second electrodes 20 and 30, respectively, decreases.

The second electrode 30 can slide in parallel with the first electrode 20. When the front end portion 31 of the second electrode 30, which is fixed on the reinforcing plate 41 disposed on the top of the ink pack 40, moves downward, the guide unit 11 smoothly guides the back end portion of the second electrode 30 in a direction parallel to the first electrode 20, for instance, to the left in FIGS. 3 and 4. A predetermined gap is maintained between the first and second electrodes 20 and 30, respectively, in the area where they face each other.

When the ink level is constant, as shown in the graph of FIG. 3, a relatively high capacitance signal S is displayed.

FIG. 4 is a side sectional view of the ink level detecting device illustrated in FIG. 3, when the cover 112 is open.

When the cover 112 is open, the first and second electrodes 20 and 30 are not in parallel anymore and the capacitance accordingly drops to approximately zero. The capacitance between the first and second electrodes 20 and 30 is proportional to the common surface area A, and is inversely proportional to the distance between the first and second electrodes 20 and 30, respectively. Therefore, as indicated by the graph in FIG. 4, the capacitance signal S drops to an extremely low level when the cover 112 is opened, because the distance between the first and second electrodes 20 and 30, respectively, increases, and the common surface area A decreases.

Figure 5:
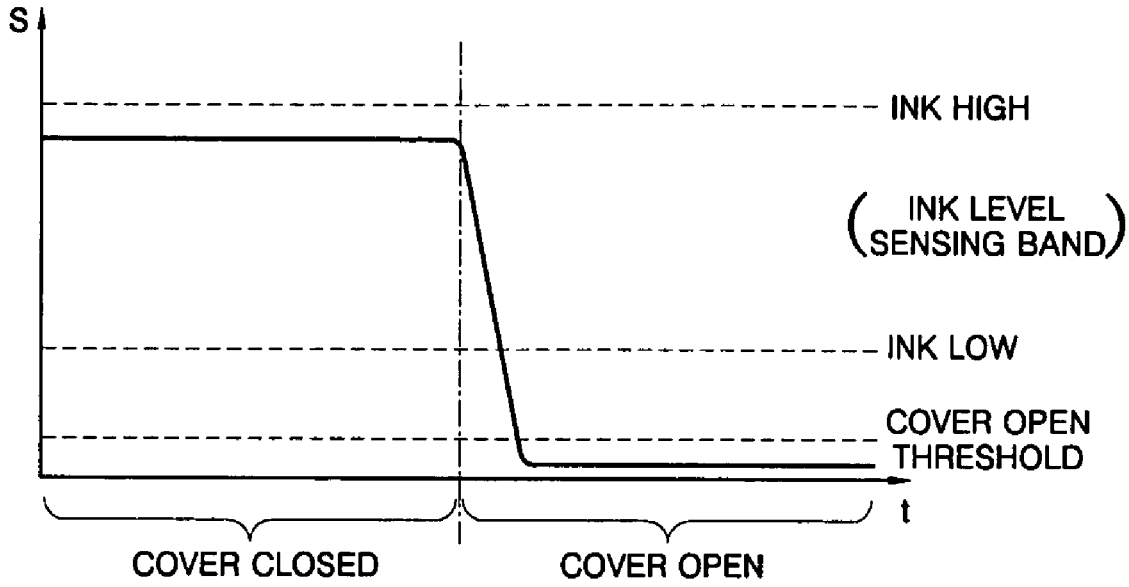
FIG. 5 is a graph illustrating a detecting signal variation when a cover is open.

FIG. 5 is a graph illustrating a detecting signal variation when the cover 112 is open.

The capacitance signal S may be measured by a capacity meter or a parameter related to the capacitance, such as an output voltage with respect to the input of an alternating current having a predetermined frequency.

When the cover 112 is closed, the capacitance signal S is maintained within an ink level sensing band between a maximum ink level (INK HIGH) and a minimum ink level (INK LOW). As the apparatus 100 uses more and more ink, the ink pack 40 shrinks in volume, causing the front end portion 31 of the second electrode 30 to smoothly slide down the guide unit 11, and this sliding correspondingly decreases the common surface area between the first electrode 20 and the top portion of the second electrode 30. This reduction in common surface area results in the capacitance signal S dropping lower and lower as the capacitance signal S approaches the INK LOW threshold. However, when the cover 112 is opened, the capacitance signal S has a value close to zero. Therefore, when the capacitance signal S drops below the cover open threshold, which is lower than the minimum ink level, the capacitance signal S displays to the user that the cover is open. In this way, the ink level detecting device can detect both the level of ink in the ink pack 40, as well as the status of the cover, i.e., whether it is open or closed.

Figure 6:
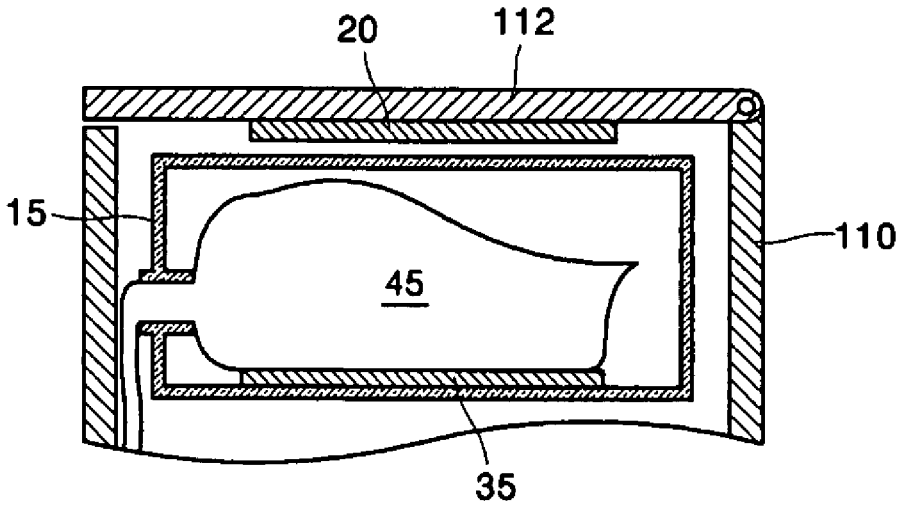
FIG. 6 is a side sectional view of an ink level detecting device according to another embodiment of the present invention, when the cover which covers an ink container mounting unit is closed.

FIG. 6 is a side sectional view of an ink level detecting device according to another embodiment of the present invention, when a cover which covers an ink container mounting unit is closed.

A first electrode 20 is placed on an inner surface of a cover 112. The cover 112 is pivotally mounted on a side portion of an ink container mounting unit 110, and a second electrode 35 is placed on an inner-bottom portion of an ink container 15 which is located within the ink container mounting unit 110. A flexible ink pack 45, formed out of a flexible film, is received in the ink container 15. The flexible film may be made out of any number of materials, such as a laminating film with an aluminum layer.

When the cover 112 is closed, the ink level detecting device of FIG. 6 detects the ink level in the ink container 15 using a mechanism where the capacitance between the first and second electrodes 20 and 35 varies as the shape of the flexible ink pack 45 varies in response to the amount of remaining ink.

Figure 7:
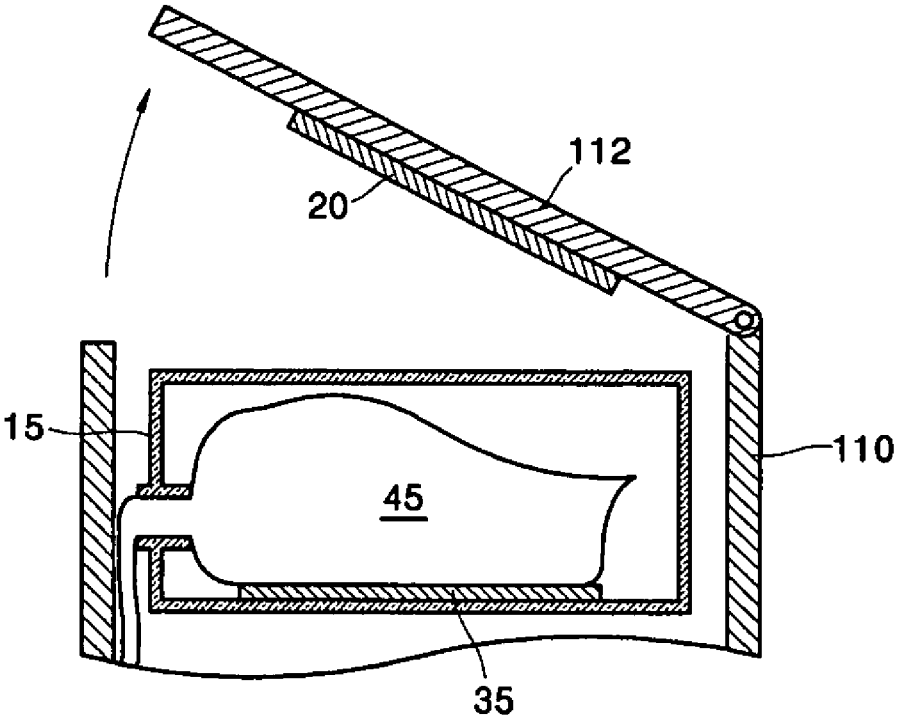
FIG. 7 is a side sectional view of the ink level detecting device illustrated in FIG. 6, when the cover is open.

FIG. 7 is a side sectional view of the ink level detecting device illustrated in FIG. 6, when the cover 112 is opened.

When the cover 112 is opened, the distance between the first and second electrodes 20 and 35 increases and the first and second electrodes 20 and 35 move out of their parallel configuration. Thus, when the cover 112 is opened, the capacitance drops to approximately zero.

Figure 8:
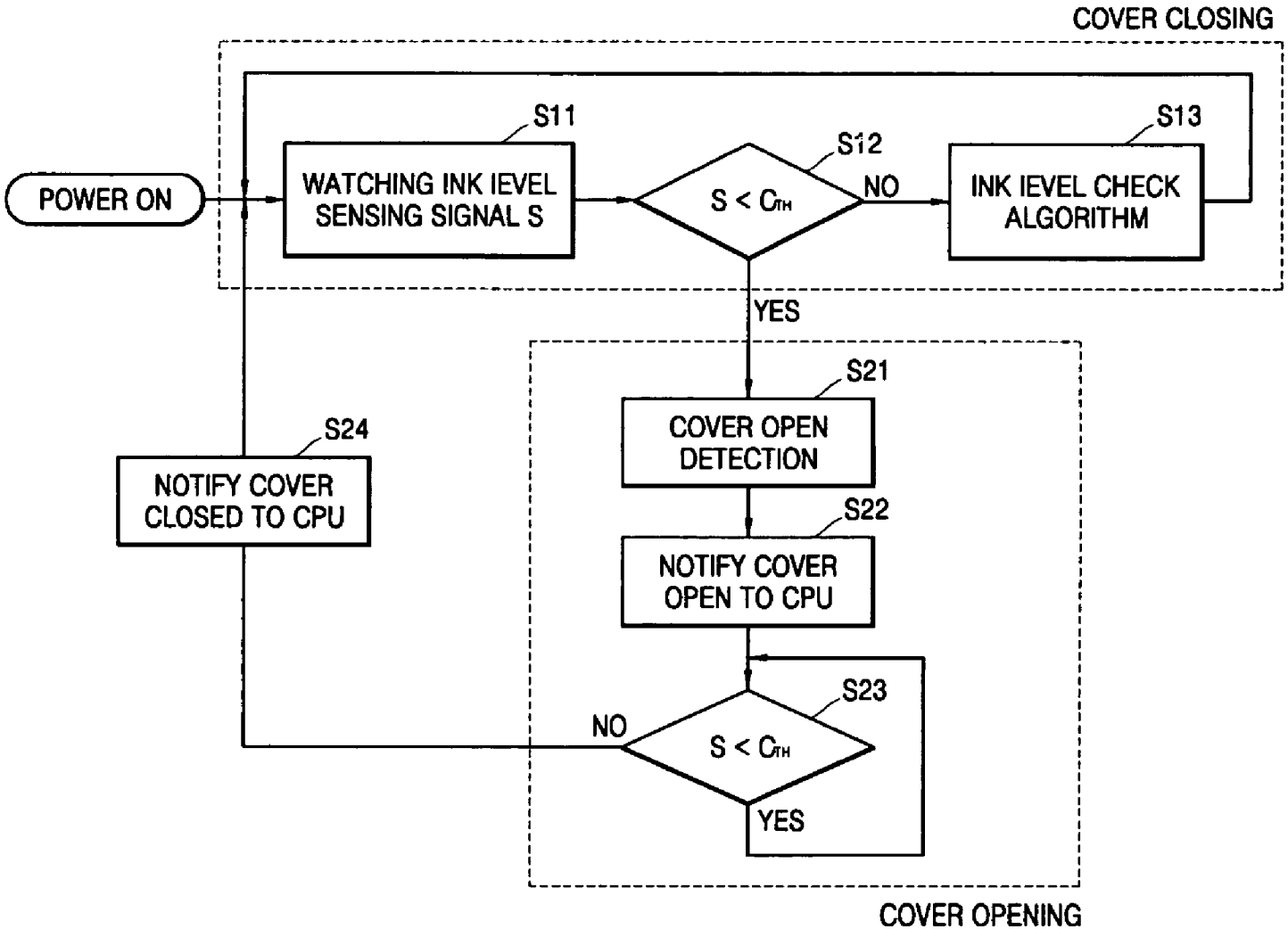
FIG. 8 is a flowchart illustrating a process which senses an opening of the cover and detects an ink level using an ink level detecting device according to various embodiments of the present invention.

FIG. 8 is a flowchart illustrating a process which senses the times when the cover 112 is opened, and detects an ink level using an ink level detecting device according to embodiments of the present invention.

When using the above-described ink level detecting device, it is possible to detect the ink level as well as the times when the cover 112 is opened through a variety of algorithms.

When the ink-jet image forming apparatus is turned on, the capacitance signal S of the ink level detecting device is read (S11). A value of the capacitance signal S is compared with the cover open threshold value (S12). When the value of the capacitance signal S is greater than the cover open threshold, i.e., when the value of the capacitance signal S is within the ink level sensing band, the ink level detecting device detects that the cover 112 is closed, and also detects the ink level through an ink level detecting algorithm (S13). On the other hand, when the value of the capacitance signal S is lower than the cover open threshold $C_{TH}$, the ink level detecting device detects that the cover 112 is open (S21).

When the ink level detecting device detects that the cover is open, the ink level detecting device sends a signal to the central processing unit of the ink-jet image forming apparatus (S22). At this point, the central processing unit stops the printing work to allow the user to prepare an ink replacement. If necessary, the status of the cover 112 may be displayed through a display unit (not shown). When the cover 112 is open, the value of the capacitance signal S is repeatedly compared with the cover open threshold $C_{TH}$. When the value of the capacitance signal S is increased and becomes greater than the cover open threshold $C_{TH}$ value, the ink level detecting device detects that the cover 112 has been closed again. Then, the central processing unit (S24) is sent a signal and the process returns to operation S11.

According to aspects of the present invention, the ink level detecting device can detect the ink level and sense the opening of the cover which covers the ink container mounting unit by electrodes respectively placed on the cover and the ink container. Therefore, the space for the ink container and the ink container mounting unit can be efficiently utilized, and the cost of components, as well as assembly costs, can be reduced.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An ink level detecting device which detects an ink level in an ink container mounted on an ink container mounting unit, the ink level detecting device comprising:

a first electrode disposed at a cover which covers the ink container mounting unit; and a second electrode disposed on the ink container, wherein the ink level detecting device detects an opening of the cover as well as variations in the ink level by sensing a capacitance variation between the first and second electrodes.

2. The ink level detecting device of claim 1, wherein a capacitance variation range is adjusted so that the capacitance variation falls outside of a variation range when the cover is open.

3. The ink level detecting device of claim 2, wherein the second electrode is formed out of a flexible conductive film.

4. The ink level detecting device of claim 3, wherein the second electrode is formed out of a thin metal plate, a thin metal film, or a synthetic resin film having a coated metal layer.

5. An ink level detecting device of an ink-jet image forming apparatus, which detects an ink level in an ink container mounted on an ink container mounting unit, the ink level detecting device comprising:

a first electrode disposed at a cover that selectively opens and closes the ink container mounting unit;

a shrinkable ink pack located within an ink container and having a top that is vertically lowered as the ink level therein is reduced; and a second electrode having a front end portion attached to the ink container and a back end portion connected to the front end portion and facing the first electrode at a predetermined distance from the first electrode when the cover is closed, wherein the front end portion of the second electrode is vertically lowered as the shrinkable ink pack runs out of ink, causing a corresponding horizontal movement of the back end portion of the second electrode so that a facing area of the first electrode and the back end portion of the second electrodes varies, wherein the ink level detecting device detects an opening of the cover as well as variations in the ink level by sensing a capacitance variation between the first and second electrodes.

6. The ink level detecting device of claim 5, wherein a capacitance variation range is adjusted so that the capacitance variation falls outside of the capacitance variation range when the cover is open.

7. The ink level detecting device of claim 5, wherein the ink container comprises a guide unit which allows the back end portion of the second electrode to slide in parallel with the first electrode, wherein the back end portion of the second electrode moves horizontally along the guide unit and the front end portion of the second electrode is fixed on a top of the shrinkable ink pack by flexibly extending along an inner-top surface and sidewall of the ink container.

8. The ink level detecting device of claim 5, wherein the shrinkable ink pack comprises a reinforcing plate disposed on the top of the shrinkable ink pack.

9. The ink level detecting device of claim 8, wherein the front end portion of the second electrode is fixed onto the reinforcing plate.

10. The ink level detecting device of claim 5, wherein the second electrode is formed out of a flexible conductive film.

11. The ink level detecting device of claim 5, wherein the capacitance variation between the first and second electrodes is detected by measuring a variation of an output voltage signal with respect to an alternating current input having a predetermined frequency.

12. The ink level detecting device of claim 11, wherein the second electrode is formed out of a flexible conductive film.

13. The ink level detecting device of claim 12, wherein the second electrode is formed out of a thin metal plate, a thin metal film, or a synthetic resin film having a coated metal layer.

14. An ink-jet image forming apparatus comprising:

an ink container mounting unit that accommodates an ink container;

a cover to selectively open and close the ink container; and an ink level detecting device that detects an ink level in the ink container, the ink level detecting device comprising, a first electrode disposed at a cover that covers the ink container mounting unit; and a second electrode disposed on the ink container, wherein the ink level detecting device detects an opening of the cover, as well as variations in the ink level, by sensing a capacitance variation between the first and second electrodes.

15. An ink-jet image forming apparatus comprising:

an ink container mounting unit that accommodates an ink container;

a cover to selectively open and close the ink container; and an ink level detecting device that detects an ink level in the ink container, the ink level detecting device comprising, a first electrode disposed at the cover, a shrinkable ink pack located within the ink container and having a top that is vertically lowered as the ink level therein is reduced; and a second electrode having a front end portion attached to the ink container and a back end portion connected to the front end portion and facing the first electrode at a predetermined distance from the first electrode, when the cover is closed, wherein the front end portion of the second electrode is vertically lowered as the shrinkable ink pack runs out of ink, causing a corresponding horizontal movement of the back end portion of the second electrode, so that a facing area of the first electrode and the back end portion of the second electrodes varies, wherein the ink level detecting device detects an opening of the cover, as well as variations in the ink level, by sensing a capacitance variation between the first and second electrodes.

16. An ink level detecting device, comprising:

a first electrode disposed at a cover that selectively opens and closes an ink container mounting unit;

a shrinkable ink pack located within an ink container and having a top that is vertically lowered as an ink level therein is reduced; and a second electrode facing the first electrode when the cover is closed which slides parallel to the first electrode as the ink level is reduced, wherein the first and second electrodes are designed to function as a capacitor and the ink level is measured by measuring the capacitance of the electrodes by measuring a common surface area A in which the first electrode and second electrodes face each other, according to the formula:

$$C=\in\cdot A/d,$$

wherein C is capacitance, $\in$ is a dielectric constant between the facing electrodes, and A is the common surface area in which the first and second electrodes face each other.

17. An ink level detecting device, which detects an ink level in ink containers mounted on an ink container mounting unit, the ink level detecting device comprising:

a first electrode disposed at a cover which covers the ink container mounting unit; and a plurality of second electrodes, wherein each ink container has a corresponding second electrode disposed on top, and the ink level detecting device detects an opening of the cover as well as variations in the ink level of each ink container by sensing a capacitance variation between the first and each of the second electrodes.

18. The ink level detecting device of claim 17, wherein the first electrode is formed in a single section on the cover.

19. The ink level detecting device of claim 17, wherein the first electrode is formed in a plurality of sections on the cover corresponding to the plurality of second electrodes.

* * * * *